United States Patent [19]

Holder

[11] 4,148,711

[45] Apr. 10, 1979

[54] CATALYTIC REFINING PROCESS FOR TANK BOTTOMS WAX

[75] Inventor: Clinton H. Holder, Westfield, N.J.

[73] Assignee: Exxon Research & Engineering Co., Florham Park, N.J.

[21] Appl. No.: 812,795

[22] Filed: Jul. 5, 1977

[51] Int. Cl.[2] ..... C10G 43/02

[52] U.S. Cl. ..... 208/27; 208/20

[58] Field of Search ..... 208/27

[56] References Cited

U.S. PATENT DOCUMENTS

| | | | |
|---|---|---|---|
| 2,956,001 | 10/1960 | Spars et al. | 208/27 |
| 3,022,245 | 2/1962 | Spars et al. | 208/26 |
| 3,089,841 | 5/1963 | Berkowitz et al. | 208/27 |
| 3,208,931 | 9/1965 | Wood | 208/27 |
| 3,275,545 | 9/1966 | McCall | 208/27 |
| 3,365,385 | 1/1968 | Kay et al. | 208/27 |

*Primary Examiner*—Herbert Levine
*Attorney, Agent, or Firm*—Edward M. Corcoran

[57] ABSTRACT

High melting, deoiled and mildly deasphalted tank bottoms wax is catalytically refined in two stages using a catalyst comprising nickel molybdate on alumina. The first stage is maintained at a temperature at least about 50° F. higher than the second stage and the temperature in the second stage is allowed to go no higher than about 575° F. Hydrofined wax product from the second stage is recycled back into same and the temperature in the first stage is periodically increased in order to counteract deactivation of the catalyst. By using a judicious combination of process conditions, unrefined high melting tank bottoms microwax stocks can be made into high quality, high melting point microwax having excellent color and meeting FDA purity requirements.

5 Claims, 2 Drawing Figures

FIGURE I

HIGH TEMPATURE GOOD FOR MICROWAX COLOR BUT LOWER TEMPERATURE FOR UV

CATALYTIC REFINING PROCESS FOR TANK BOTTOMS WAX

BACKGROUND OF THE INVENTION

1. Field of the Invention

This invention relates to a wax hydrofining process. More particularly, this invention relates to a process for hydrofining high melting microwax stocks such as deasphalted tank bottoms wax over a nickel or cobalt molybdate on alumina catalyst in two successive stages, with the temperature in the second stage not exceeding about 550° F. and being maintained at least about 50° F. lower than the temperature in the first stage, recycling the hydrofined wax product back into the second stage, and periodically increasing the temperature in the first stage as the catalyst ages.

2. Description of the Prior Art

Microcrystalline wax is used in the manufacture of many products such as food containers, waxed papers, coating materials, electrical insulators, candles, etc., and is usually obtained from the highest boiling fraction of a crude oil. In the manufacture of conventional microcrystalline waxes, the bottoms stream from a vacuum pipestill is deasphalted to produce a heavy deasphalted oil which is then extracted to partially remove aromatics therefrom. The term microcrystalline wax generally refers to deoiled (to less than about 5 wt.% oil) wax having a melting point varying from about 140° to 180° F. which is recovered from this deasphalted, extracted oil by dewaxing and deoiling. The term petrolatum applies to the non-deoiled residual microwax having an oil content of 30 to 40%.

The wax recovered from the lower boiling vacuum pipestill side streams is generaly termed paraffin wax. Both deoiled residual microwax and petrolatum are much more difficult to refine than paraffin wax because they are higher in molecular weight and contain many more cyclic structures particularly aromatics and fewer straight chain n-paraffins. The raw microwax obtained by such a process is characterized by a poor odor, a dark color and it contains aromatic impurities as shown by ultraviolet absorption tests. Thus the microwax must be furthe refined in order to obtain useful products therefrom. In the past microwax was contacted with solid absorbent materials such as bauxite or clay to absorb the aromatic compounds therefrom which impart the unfavorable properties to the wax.

Various improvements in the refining of microcrystalline waxes have been made over the years, most notable of which have been those directed towards catalytic refining of the wax in the presence of hydrogen, also known as hydrofining. For example, U.S. Pat. No. 3,052,622 discloses taking a crude oil residua and simultaneously deasphalting and extracting the aromatics from it via the Duo-Sol process to obtain a waxy petroleum residue which is then hydrofined by passing the wax, in the presence of hydrogen, over a catalyst of nickel oxide on bauxite. The hydrofined product is then dewaxed via a conventional solvent dewaxing process using toluene and MEK as the dewaxing solvents. U.S. Pat. No. 3,022,245 discloses a relatively low pressure process for hydrofining paraffin waxes having melting points of from about 115° to 155° F., by using a cobalt molybdate on alumina catalyst and treating the wax in two stages at relatively low pressures of less than 1000 psig with the temperature in the second stage maintained about 100° F. lower than the temperature in the first stage. U.S. Pat. No. 3,275,545 discloses a low pressure, single stage process for hydrofining conventional microwaxes using catalysts containing from 2 to 5 wt.% cobalt oxide and 8 to 15 wt.% molybdenum oxide and recycling a portion of the hydrofined product back into the inlet of the hydrofining zone in order to maintain the concentration of multi-ring aromatic hydrocarbons therein below about 4% by weight thereby avoiding deactivation of the catalyst. Preferred pressures in the hydrofining zone are disclosed as varying between about 500 and 1000 psig. U.S. Pat. No. 3,365,385 discloses another low pressure process for hydrofining microwax using a cobalt molybdate catalyst wherein the pressure in the hydrofining zone is maintained below 900 psig. Critical features are the use of low space velocities and a liquid phase reaction wherein the catalyst is kept submerged in liquid feed.

However, none of the prior art processes for hydrofining microcrystalline waxes have been found satisfactory for use with tank bottoms wax. Tank bottoms wax differs from ordinary microcrystalline waxes in that it is derived from the whole crude oil. That is, crude oil is pumped out of the ground and transferred to storage tanks in the oil fields and then sent to refineries. In the storage tanks, a relatively high boiling, high melting point microcrystalline wax slowly precipitates from the crude oil as same cools off in the tanks and deposits or plates out on the bottom and on the walls inside the tanks. This wax is referred to as tank bottoms wax. Periodically, the tanks must be completely drained and scraping equipment is used to scrape out the wax, from whence is derived the term tank bottoms wax. The melting point of this wax is higher than ordinary microcrystalline wax in that it is usually at least about 190° F. and contains a substantially higher amount of aromatic and naphthenic and some asphaltic constituents. In addition, tank bottoms wax contains high boiling components which are not in ordinary residual microwax. These composition differences explain the high hardness and melting point of tank bottoms wax and its refractory nature in that it is more difficult to hydrofine because of its higher aromatics content. This wax is presently refined by deasphalting, deoiling and then contacting with bauxite or other solid absorbent in order to remove the aromatics therefrom and then acid treating to produce a refined wax of good color, odor and color stability that can be used for various purposes which require meeting FDA requirements such as for food container linings, etc. It would be a useful contribution to the art therefore if a way could be found to hydrofine this tank bottoms wax instead of having to use the rather expensive and cumbersome solid adsorption methods.

SUMMARY OF THE INVENTION

It has now been found that deoiled and mildly deasphalted tank bottoms wax can be hydrofined via a two-stage catalytic process comprising sequentially contacting said wax and hydrogen with a hydrofining catalyst in a first stage at a temperature ranging from about 550° to 700° F. and then contacting the reaction mixture from said first stage with a hydrofining catalyst in a second stage at a temperature between about 400° and 575° F. and wherein the temperature in the second stage is at least about 50° F. lower than the temperature in the first stage. The amount of catalyst in the first stage may be present in an amount less than that in the second stage. As the catalyst ages, a portion of hydrofined wax product from the second stage is recycled back into said second stage. Further, the temperature in the first stage must be slowly increased as time progresses in order to compensate for gradual but permanent deactivation of the catalyst contained therein due to carbonaceous deposits.

The deoiled (to a maximum of 5 wt.% oil) tank bottoms wax should be deasphalted mildly in order not to destroy desirable quality features of the wax such as hardness and melting point, but enough to improve the response to hydrofining. It is desirable to deasphalt the wax sufficiently to reject a resinous or asphaltic phase of 10 to 20 wt.% but not more than 25 wt.%. After deasphalting, the wax should exhibit a UV absorption no greater than 0.70 at a wave length of 290 nm measured by ASTM D-2008 and more preferably not greater than 0.65, with a color no worse than from 8 undiluted or up to 3½ diluted 15% in heptane as measured by ASTM D-1500 and having an asphaltene content no greater than 100 wppm and more preferably no greater than 50 wppm as measured by a Heptane Insoluble test. In this test, one volume of wax is dissolved in ten volumes of warm n-heptane, which was prefiltered through 0.8 micron filter paper. The resulting wax solution is vacuum filtered through 0.8 or 0.9 micron filter paper under a heat lamp. The filter paper is placed in a 150 ml beaker to which is added 50 ml of n-heptane and heated to boiling. The filter paper is replaced in the filter and the liquid contents of the beaker are filtered through it under a heat lamp followed by four 100 ml washes of warm n-heptane. The filter paper is dried to constant weight and the heptane insolubles obtained by difference.

In general, the melting point of this wax will be at least about 180° F. and more typically 190° to 200° F. One of the most important distinguishing characteristics of this microcrystalline wax, as compared to microcrystalline waxes from other sources, is its high melting point and high hardness. From the standpoint of refining the deasphalted tank bottoms wax to usable products, the most distinguishing feature is the extremely high absorbence in the ultra-violet region caused by the content and type of multi-ring aromatic and naphthenic compounds. Table 1 lists properties of a deoiled, mildly deasphalted tank bottoms wax that has been deasphalted with propane to two different wax yields which meet the requirements of feeds suitable for use in this invention. For comparison, a conventional microwax is also shown. Comparison of the data in Table 1 under step B of the FDA UV absorbence test reveals that UV absorbence for the tank bottoms wax is 20 times more than for conventional microwax derived from crude residua. In fact, because of the relatively high concentration of aromatic compounds in the wax it was initially thought that any practical hydrofining process would not work with a tank bottoms wax feed.

Finally, although the process of this invention was developed for hydrofining a deoiled and mildly deasphalted tank bottoms wax, any microwax feed may be hydrofined by this process including ordinary microcrystalline waxes and petrolatums.

Hydrofining catalysts suitable for use in the process of this invention are selected from the group consisting of cobalt molybdate, nickel molybdate and mixture thereof on a solid absorbent base or carrier, with nickel molybdate being most preferred. These catalysts are known hydrofining catalysts and can be purchased commercially. The base or carrier may be selected from materials such as absorptive alumina, bauxite, promoted alumina, and the like, which are usually employed for this purpose. A material which is particularly effective is alumina. In general, the catalyst should contain from about 2 to 6 wt.% cobalt oxide and 10 to 18 wt.% molybdenum oxide with from 3 to 4 wt.% cobalt oxide and 12 to 14 wt.% molybdenum oxide being more

TABLE 1

PROPERTIES OF DEASPHALTED TANK BOTTOMS WAX AND CONVENTIONAL MICROWAX

| | | Deasphalted Tank Bottom Microwax | | Conventionl Microwax |
|---|---|---|---|---|
| Feed Designation | | A | B | C |
| Deasphalted Wax Yield, % | | 81 | 84 | — |
| Microwax Quality | | | | |
| Viscosity, SSU at 210° F. | | 72.5 | 80.1 | 77.9 |
| Penetration at 77° F., ASTM D-121 | | 5.8 | 4.1 | 25 |
| Melting Point, ° F., ASTM D-127 | | 193 | 196 | 175 |
| UV Absorption at 290 nm, ASTM D-2008 | | 0.465 | 0.623 | — |
| Color, ASTM D-1500 | | 5.1 | >8(2) | 6.5 |
| Oil Content, Wt.% | | 2.6 | 2.3 | 3.9 |
| Sulfur, Wt.% | | 0.018 | 0.042 | — |
| Conradson Carbon on 50% Bottoms, Wt.% | | — | 0.33 | — |
| n-Heptane Insolubles, wppm | | 18 | 58 | — |
| Purity by UV Absorption at Following Wave Lengths(1) | | | | |
| Step A | 280–289 nm | 19.9 | 14.0 | — |
| | 290–299 nm | 15.4 | 11.8 | — |
| | 300–359 nm | 11.2 | 8.8 | — |
| | 360–400 nm | 1.69 | 1.52 | — |
| Step B | 280–289 nm | 10.1 | 8.92 | 0.330 |
| | 290–299 nm | 8.3 | 6.82 | 0.279 |
| | 300–359 nm | 6.1 | 5.06 | 0.212 |
| | 360–400 nm | 1.4 | 0.76 | 0.033 |

(1)Test procedure 21 CFR 121.1156 of the U.S. Food and Drug Administration.
(2)ASTM color of 3.6 when diluted 15 parts wax to 85 parts heptane.

particularly preferred. In the case of a nickel molybdate catalyst, the catalyst should contain from 2.0 to 6.0 wt.% nickel oxide and 10 to 20 wt.% molybdenum oxide, more preferably 3.0 to 4.0 wt.% nickel oxide and 17.0 to 19.0 wt.% molybdenum oxide on alumina based on the total catalyst weight. The oxide should be converted to the sulfide prior to use in this invention. This may be accomplished by first heating the catalyst in the presence of $CS_2$ and hydrogen or $H_2S$ and hydrogen at temperatures between about 400° to 500° F., followed by increasing both the amount of $H_2S$ or $CS_2$ present and raising the temperature to about 600° F.

It is important to the operation of this invention to use at least two hydrofining stages, with the second stage operating at a temperature lower than that in the first stage. These stages are obtained by containing the catalyst in multiple reactors with heat exchange at one or more inter-reactor positions. In the case of a two stage configuration, the best utilization of catalyst is achieved by having more than half the catalyst in the second stage, i.e., 51 to 70% of the catalyst should be in the second stage. It has been found that the color and UV product qualities of the microwax have different temperature responses. The product color of the microwax is improved over a wide range of temperature up to about 700° F. The reactions which improve color are not limited by chemical reaction equilibria. On the other hand, the lowest UV absorption on the microwax product in the Food and Drug Administration UV test is achieved by hydrofining at lower temperatures such as between about 450° and 550° F. The UV absorption becomes undesirably high as temperature is increased up to 600° F. or more. This critical wax purity test requires exhaustive hydrogenation of aromatic bonds. Such a high degree of aromatic bond saturation is needed that UV absorption tends to be equilibrium limited. Equilibrium is more favorable for hydrogenation at low temperature. Hence, in order to make high purity tank bottoms microwax one must second stage temperatures high enough for reasonable reaction rates, but not too high for equilibrium.

Thus, the first stage or zone will operate at a temperature ranging from about 550° to 700° F. and more preferably from 600° to 660° F. while the second stage will operate at a temperature from 400° to 575° F., more preferably from 400° to 550° F. and still more preferably from 500° to 550° F. The partial pressure of the hydrogen in both stages may range anywhere from about 1000 to 3500 psig and more preferably from 1500 to 2500 psig. The product quality improvement reactions discussed above are dependent upon hydrogen partial pressure but not total operating pressure. The fresh feed rate will range from about 0.15 to 0.50 V/H/V (volume of feed per hour per volume of catalyst) with the reaction products from the first stage being fed directly to the second stage. As hereinbefore mentioned, the temperature in the second stage or zone should be at least about 50° F. lower than that in the first stage or zone and preferably not be allowed to go higher than 575° F.

Another aspect of the instant invention is recycle of product exiting from the second hydrofining stage back to the entrance thereof wherein it is mixed with the reaction mixture coming from the first stage. The ratio of the recycled product to the reaction mixture entering the second stage may range from 0 to about 5:1 volumes of second stage product per volume of fresh wax feed entering the first stage but preferably no more than 2:1 depending on the rate of recycle needed to meet the specified FDA UV absorption test below.

Through product recycle, unconverted aromatics are more completely saturated by additional exposure to the catalyst and hydrogen partial pressure. Regulation of recycle ratio is as required in order for the refined wax to meet the FDA UV absorption specification per 21 CFR 121.1156 (step B in Table 4) as the catalyst ages.

Finally, any ASTM or 21 CFR test method referred to herein refers to that test method published and in effect as of the year 1976.

BRIEF DESCRIPTION OF THE DRAWING(S)

DETAILED DESCRIPTION

Figure 1:
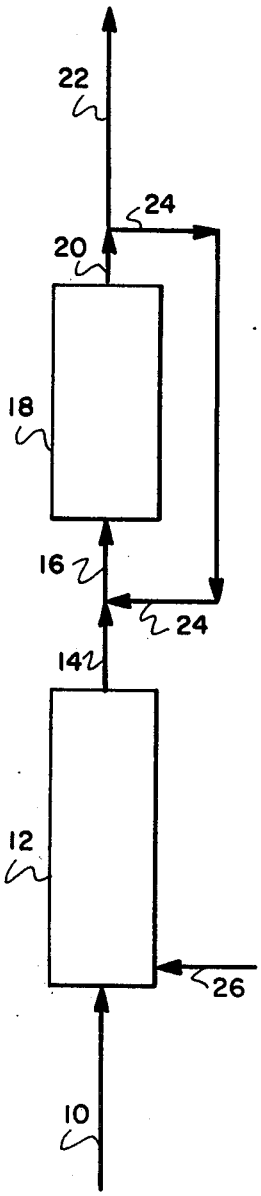
FIG. 1 is a flow diagram of a preferred embodiment of a two stage hydrofining process including recycle of product applying the operation of the instant invention.

Referring to FIG. 1, deasphalted tank bottoms wax at a temperature of about 230° F. is passed into first hydrofining stage 12 via line 10 wherein it is mixed with hydrogen entering said stage via line 26, the mixture being contacted in stage 12 with a nickel molybdate hydrofining catalyst. Stage 12 operates at a temperature typically of about 550° to 700° F. including a hydrogen partial pressure of about 1000 to 3500 psig. Reaction mixture from stage 12 is passed to the second hydrofining stage 18 via lines 14 and 16 wherein it is again contacted with a nickel molybdate on alumina catalyst. Stage 18 operates at a temperature ranging from about 400° to 550° F. and a hydrogen partial pressure of about 1000 to 3500 psig. The hydrofined wax product exits from second stage 18 via line 20 and line 22 wherein it is sent to liquid/vapor separators and from there to a stripper where light hydrocarbons are removed to meet flash point specifications.

A portion of the hydrofined wax product is passed via line 24 back to lines 14 and 16 wherein it is mixed with reaction product coming from first stage 12 and with the total mixture then being passed into second hydrofining stage 18. The recycle ratio varies from 0 to 5 volumes of second stage product recycled per volume of first stage fresh feed with the amount of recycle depending upon aromatics saturation as shown by the FDA UV absorption test.

The temperature in the first zone is increased at an average rate of between 0.05° to 0.2° F. per day, depending on the temperature needed to meet color specifications of 1.0 maximum when measured by ASTM D-1500.

PREFERRED EMBODIMENTS

The following examples further illustrate the present invention. Unless otherwise specified, all percentages and parts are by weight.

EXAMPLE 1

Figure 2:
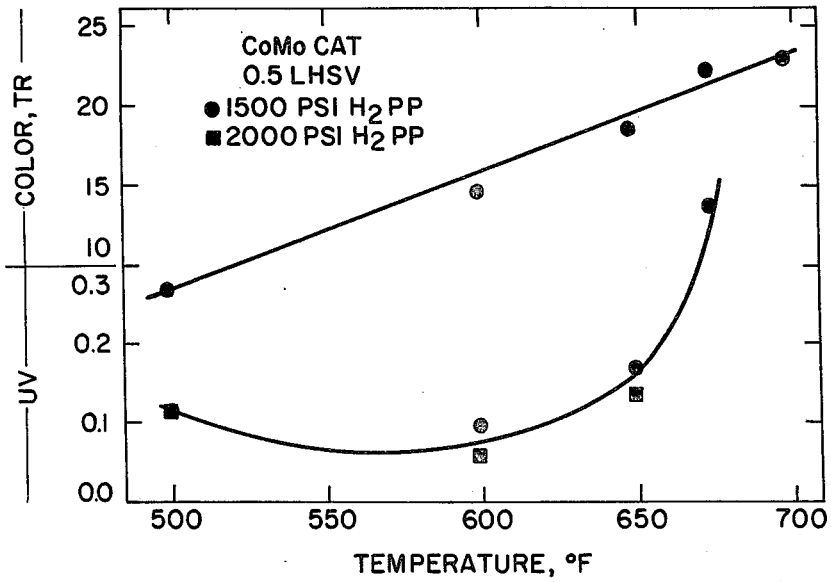
FIG. 2 is a graph illustrating the different response of color and UV characteristics of the wax as a function of hydrofining temperature.

FIG. 2 shows the difference in the temperature effect on the chemical reactions for color improvement and for aromatics hydrogenation (as measured by the FDA UV absorption test). To do this, experiments were conducted over a cobalt molybdate catalyst at a feed rate of 0.5 V/H/V at a series of temperatures with the entire catalyst bed at a single temperature. FIG. 2 shows that the color of the product wax improved over the entire range as temperature increased from 500° to 700° F. On the other hand, the UV absorption got lower at first, reached its best value which is a minimum and then got higher or worse at temperatures of 600° F. and above. From these experiments it was clear that the conditions which give maximum color improvement are incompatible with obtaining the lowest UV absorption. This problem was solved by dividing the catalyst into unequal zones at different temperatures which could then be treated differently to maximize both color improvement and UV absorption. This also made it possible to combat deactivation as the operating time on the catalyst progressed.

EXAMPLE 2

The data shown below illustrate the critical nature of temperature conditions in order to meet the color and FDA UV purity specifications. The tests were carried out using feed stock designated B in Table 1. The catalyst was nickel molybdate on alumina. The temperature difference between zones one and two was maintained at a difference of 100° F. but the temperature level was increased in each run. The catalyst distribution was two-thirds in the second stage and one-third in the first.

TABLE 2

| Hydrofining Conditions | Feed Type B | A | B | C |
|---|---|---|---|---|
| $H_2$ Partial Pressure psig | | —— | 2000 | —— |
| Space Velocity, V/H/V | | —— | 0.25 | —— |
| First stage, ° F. | | 600 | 625 | 650 |

TABLE 2-continued

| | | | | | |
|---|---|---|---|---|---|
| Second Stage, ° F. | | 500 | 525 | 550 | |
| % Catalyst Second Stage | | ——— | 66.7% | ——— | |
| Properties | | | | | Specifications |
| Color, ASTM D-1500 | >8 | 0.9 | 0.7 | 0.4 | 1.0 max. |
| Color, Tag Robinson | <1 | 18½ | 19 | 22½ | — |
| FDA UV Absorption 21 CFR 121.1156 | | | | | |
| Step A 280–289 | 14.0 | .293 | .162 | .112 | — |
| 290–299 | 11.8 | .185 | .167 | .108 | — |
| 300–359 | 8.8 | .219 | .131 | .113 | — |
| 360–401 | 1.5 | .023 | .019 | .005 | — |
| Step B 280–289 | 8.9 | .098 | .036 | .060 | .150 max. |
| 290–299 | 6.8 | .115 | .053 | .073 | .120 max. |
| 300–359 | 5.1 | .093 | .046 | .093 | .080 max. |
| 360–400 | 0.8 | .004 | .006 | .017 | .020 max. |
| | | Fail | Pass | Fail | |

As the first stage temperature was increased, the color continued to improve. The best results on the FDA UV absorption test were obtained with the second stage temperature at 525° F. The highest temperature combination gave the best color, but failed the FDA test.

EXAMPLE 3

This example illustrates the employment of operating condition adjustments to combat the effects of catalyst deactivation on product quality. The temperature of the first stage is increased, as needed, to maintain the product color on target as the catalyst ages. The FDA UV absorption test is maintained at its specification by recycle of product back to the inlet of the second stage. The frequency of adjustments of both these conditions is, as required, to meet wax product specifications. This is illustrated in Table 3.

By these operating condition adjustments, which are most suitable to each of the reaction zones, the useful life of the catalyst is extended over what would otherwise be obtained.

TABLE 3

| Days of Operation | Feed Type B | 100 | | 600 | |
|---|---|---|---|---|---|
| Operating Pressure, psig | | 2400 | | 2400 | |
| $H_2$ Partial Pressure, psig | | 2000 | | 2000 | |
| Gas Rate, SCF/B | | 3500 | | 3500 | |
| Fresh Feed Rate Overall, LHSV | | 0.25 | | 0.25 | |
| Catalyst Stage(2) | | First | Second | First | Second |
| % Total Catalyst | | 33 | 67 | 33 | 67 |
| Temperature, ° F. | | 600 | 500 | 650(3) | 500 |
| Product Recycle(1) | | 0 | 0 | 0 | 2/1 |
| Wax Product Specification | | | | | |
| Color, ASTM D-1500 | >8 | — | 1.0 ASTM | — | 1.0 ASTM |
| FDA UV Absorption 21 CFR 121.1156 | | | | | |
| Step B 280–289 | 8.9 | | 0.150 | | 0.150 |
| 290–299 | 6.8 | | 0.120 | | 0.120 |
| 300–359 | 5.1 | | 0.080 | | 0.080 |
| 360–400 | 0.8 | | 0.020 | | 0.020 |

Notes:
(1)Ratio of wax product recycled to stage two to the feed entering stage one.(2)Catalyst is nickel molybdate on alumina.
(3)Average rate of temperature increase is 0.1° F. per day over about a 500 day period.

EXAMPLE 4

This example shows that higher deasphalting severity makes the tank bottoms wax much easier to hydrofine. The test was carried out with nickel molydate on alumina catalyst using feedstock A from Table 1. The following results were obtained.

TABLE 4

| | Feed A | Hydrofined Product | |
|---|---|---|---|
| Deasphalted Wax Yields, LV % | 81 | — | |
| Hydrofining Conditions | | | |
| $H_2$ Partial Pressure, psig | | 2000 | |
| Space Velocity, V/H/V | | 0.5 | |
| First Stage, ° F. | | 650 | |
| Second Stage, ° F. | | 500 | |
| % Catalyst Second Stage | | 50 | |
| Properties | | | Specifications |
| Color, ASTM D-1500 | 5.1 | >0.1 | 1.0 max. |
| Color, Saybolt, ASTM D-156 | — | 20 | — |
| EDA UV Absorption 21 CFR 121.1156 | | | |
| Step A 280–289 | 19.9 | .063 | — |
| 290–299 | 15.4 | .053 | — |
| 300–359 | 11.2 | .060 | — |
| 360–400 | 1.69 | .002 | — |
| Step B 280–289 | 10.1 | .007 | .150 (max.) |
| 290–299 | 8.3 | .005 | .120 (max.) |
| 300–359 | 6.1 | .007 | .080 (max.) |
| 360–401 | 1.4 | .001 | .020 (max.) |
| | | Pass | |

The hydrofined wax was almost white in color and met the color and UV absorption specifications with an unusually wide margin as shown by the data in Table 4. A similar run made with the less severly deasphalted feedstock B produced a wax product which did not meet the requirements of both color and UV absorption.

What is claimed is:

1. A process for hydrofining a deoiled, deasphalted tank bottoms microwax containing no more that 5 wt.% oil, having a melting point of at least about 180° F. and exhibiting a UV absorption no greater than 0.70 at a wave length of 290 nm measured by ASTM D-2008 which comprises contacting said wax and hydrogen with a hydrofining catalyst in a first stage at a temperature ranging from 550° to 700° F. to produce a reaction mixture and then contacting said mixture and hydrogen with a hydrofining catalyst in a second stage at a temperature between about 450° to 575° F. and at least 50° F. lower than the temperature in the first stage to produce a hydrofined microwax product having a color of not more than 1.0 as measured by ASTM D-1500 and gradually increasing the temperature of the catalyst in the first stage to overcome loss of catalyst activity therein as the catalyst ages and wherein the hydrogen pressure in said stages ranged from between about 1000 to about 3500 psig, the amount of catalyst in the second stage being greater than the amount of catalyst in the first stage, said hydrofined product meeting the requirements of step B of 21 CFR 121.1156 as herein defined.

2. The process of claim 1 wherein the catalyst in said first and said second stages is selected from the group consisting of cobalt molybdate, nickel molybdate and mixture thereof on an alumina support.

3. The process of claim 2 wherein said deasphalted microwax has an asphaltene content no greater than 100 wppm.

4. The process of claim 2 wherein up to 5 volumes of product from the second stage per volume of first stage feed are recycled back into the second stage.

5. The process of claim 4 wherein the temperatures in the first and second stages range from 600° to 660° F. and 400° to 550° F., respectively, and wherein the hydrogen pressure in both stages ranges from 1500 to 2500 psig.

* * * * *